US007062213B2

(12) United States Patent
Ishikura et al.

(10) Patent No.: US 7,062,213 B2
(45) Date of Patent: Jun. 13, 2006

(54) SHEET FEEDER, IMAGE READING APPARATUS, AND IMAGE FORMING APPARATUS

(75) Inventors: Kaoru Ishikura, Kyoto (JP); Takashi Imai, Nara (JP); Shuhji Fujii, Kyoto (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 169 days.

(21) Appl. No.: 10/876,320

(22) Filed: Jun. 24, 2004

(65) Prior Publication Data

US 2005/0002710 A1 Jan. 6, 2005

(30) Foreign Application Priority Data

Jul. 2, 2003 (JP) ..... 2003-190651

(51) Int. Cl.
*G03G 15/00* (2006.01)

(52) U.S. Cl. ..... 399/367; 399/371; 271/157

(58) Field of Classification Search ..... 399/367, 399/371; 271/145–157
See application file for complete search history.

(56) References Cited

U.S. PATENT DOCUMENTS

| | | | | |
|---|---|---|---|---|
| 4,763,891 | A * | 8/1988 | Kodama | 271/157 |
| 5,100,122 | A * | 3/1992 | Noda et al. | 271/155 |
| 6,091,927 | A | 7/2000 | Hattori et al. | 399/367 |
| 6,361,038 | B1 * | 3/2002 | Tada et al. | 271/111 |

FOREIGN PATENT DOCUMENTS

| | | |
|---|---|---|
| JP | 03272922 A * | 12/1991 |
| JP | 08-119468 | 5/1996 |
| JP | 11-199065 | 7/1999 |

* cited by examiner

*Primary Examiner*—Minh Chau
(74) *Attorney, Agent, or Firm*—Renner, Otto, Boisselle & Sklar, LLP

(57) ABSTRACT

In accordance with the state of a document tray upon powering on a power source, the elevation operation of a document tray is controlled. In the case that the document tray is located not at the highest position, not at the lowest position, but at a middle position upon powering on the power source, the document tray is allowed to remain at the middle position as it is without performing the elevation of the document tray. In the case that the document tray is located at the highest position, the document tray is moved down. By reducing the wasteful operation (the initial operation) after powering on the power source, it is possible to reduce the operation time and the efficient sheet processing can be realized.

21 Claims, 12 Drawing Sheets

SHEET FEEDER, IMAGE READING APPARATUS, AND IMAGE FORMING APPARATUS

CROSS-REFERENCE TO RELATED APPLICATIONS

This Nonprovisional application claims priority under 35 U.S.C. §119(a) on Patent Application No. 2003-190651 filed in Japan on Jul. 2, 2003, the entire contents of which are hereby incorporated by reference.

BACKGROUND OF THE INVENTION

The present invention relates to a sheet feeder which is equipped with an image reading apparatus such as a copying machine or a scanner or an image forming apparatus such as a printer or a facsimile machine and which sequentially takes out sheets of document contained in a sheet container in a stacked manner to feed and carry the sheets to a carrier path. The present invention also relates to an image reading apparatus and an image forming apparatus that comprise this sheet feeder.

In recent years, an image forming apparatus or the like has been provided with an apparatus for reading an image of the sheet while automatically and sequentially taking and carrying the sheets of document one by one, so that the image is efficiently read and formed. On the other hand, due to progress of a digital technology, a speed of reading an image from the document, a speed of converting the read data into the electronic data and a speed of forming an image from the electronic data rise, and this makes it possible to process more documents at a high speed. Such a reading apparatus can contain a large number of sheets in a tray (a sheet container), namely, about 100 to 200 sheets. In addition, in accordance with progress of a document carrier of the image reading apparatus, various kinds of sheets can be carried.

Thus, if the number of mounted sheets is increased, in the configuration such that the height position of the tray is fixed, it is difficult to make a taking-out condition of each sheet from the tray even, so that an apparatus has been known, which enables to move up and down the tray by an elevating mechanism and maintains the highest face of the sheet contained n the tray at a predetermined height (see, for example, Japanese Patent Application Laid-Open No. 11-199065 (1999), referred as a prior apparatus below). The prior apparatus intends to acquire an effect of improving a convenience of the containing operation of the sheet by moving down the tray at the lowest position when powering on the apparatus.

In the image reading apparatus for reading the image of the sheet while containing a large number of sheets such as documents in the tray and feeding and carrying them, there is a problem such that it takes a long time from the tray is moved up till the sheet can be fed to a carrier path so as to make a total reading time till reading of the sheet is completed longer when putting a tray having a large capacity for mounting the sheet on standby, moving up the tray by a signal with respect to the key operation or the like for initiating reading of the sheet, and initiating the operation for feeding the sheet to the carrier path for carrying the sheet to a reader.

In the prior apparatus, the tray is moved down to the lowest position even when there are a few sheets to be set, so that it takes a long time for moving up the tray from picking up the sheet till feeding and carrying it. In addition, in recent years, a time from powering on the apparatus till start of the operation has been shortened and an apparatus that is powered off in ordinary state without turning on electricity and is powered on upon using has been developed. Since such an apparatus is turned off usually, before powering on, the sheet may be contained therein. In this case, there is a problem such that the tray is moved down to the lowest position by powering on to cause wasteful operations.

In order to solve such a problem, various methods are tried, for example, before acquiring a signal of reading start, a default height of the tray is set not at the lowest position where the maximum number of sheets can be set but at the higher position capable of setting a predetermined number of sheets; detecting that any key of an operation unit is pushed for setting an operation mode or the like, the tray is moved up so as to stand ready to feed the sheet immediately; and the tray is automatically on standby for feeding the sheet immediately when a predetermined passage of time.

However, according to the apparatus controlled to set the tray not at the lowest position but at a predetermined height, the initial operation of the tray is carried out upon powering on and a standard height of the tray is detected, and then, the tray is moved so as to be at a predetermined height. This is also wasteful operation for making a time from powering on till start of operation shorter as described above.

BRIEF SUMMARY OF THE INVENTION

The present invention has been made taking the foregoing problems into consideration and an object of which is to provide a sheet feeder capable of reducing the wasteful operation after powering on and making the operation time shorter by controlling the elevation operation of a tray depending on a state of the tray (sheet container) upon powering on, and an image reading apparatus and an image forming apparatus that are provided with this sheet feeder.

The sheet feeder according to the present invention includes a sheet container for containing a plurality of sheets in a stacked manner, an elevator for moving up/down the sheet container, a sheet carrier for carrying an abutted sheet to a carrier path when the sheet container is moved up by the elevator, and a detector for detecting that the sheet container is located at a predetermined position, wherein in the case that the detector does not detect that the sheet container is located at the predetermined position upon powering on, the sheet container is remained at the position as it is without operating the elevator.

In the sheet feeder according to the present invention, when the sheet container is not located at the predetermined position (the highest position or the lowest position) upon powering on, it is determined that the sheet container is located at a middle position, the sheet container is remained at the position as it is without performing the elevation operation of the sheet container. It is therefore possible to reduce the wasteful operation (the initial operation), to shorten the operation time and to realize the efficient processing of the sheet.

In the sheet feeder according to the present invention, the predetermined position is the highest position of an elevation range of the sheet container, and the controller moves down the sheet container by means of the elevator in the case that the detector detects that the sheet container is located at the highest position.

In the sheet feeder according to the present invention, since the sheet cannot be set when the sheet container is located at the highest position, by moving down the sheet container, the sheet can be set in the sheet container. In this case, if the moving-down amount of the sheet container is not set at the maximum moving-down amount but at a predetermined amount, it is possible to reduce the necessary time for the operation in accordance with the operation start signal after setting the sheet.

In the sheet feeder according to the present invention, the predetermined position is the lowest position of an elevation range of the sheet container, and the controller moves up the sheet container by means of the elevator or remains the sheet container at the position as it is without operating the elevator in the case that the detector detects that the sheet container is located at the lowest position.

In the sheet feeder according to the present invention, since the sheet can be set in the sheet container when the sheet container is located at the lowest position, the sheet container is prevented from being moved by operating the elevator after powering on, it is not necessary to wait for the setting processing of the sheet into the sheet container till the initial operation has been completed. Alternatively, according to the apparatus having the sheet container with a large capacity, by moving up the sheet container to a predetermined position and making the sheet container standby, it is possible to reduce the necessary time for the operation in accordance with the operation start signal after setting the sheet.

The sheet feeder according to the present invention includes an operation unit for giving an instruction to elevate the sheet container to the elevator, wherein in the case that the detector does not detect that the sheet container is located at the predetermined position, the controller moves down the sheet container by means of the elevator when the operation of the operation unit is confirmed.

In the sheet feeder according to the present invention, when the sheet container is maintained at a higher middle position and the sheet cannot be set, by operating the operation unit (for example, an elevation key), it is possible to move down the sheet container so as to easily cope with the case such that many sheets are fed.

In the sheet feeder according to the present invention, the detector detects a position of the uppermost layer of the sheet contained in the sheet container, and in the case that the detector detects that the uppermost layer of the sheet is higher than a standard position by means of the detector when the sheet is contained in the sheet container, the controller moves down the sheet container by means of the elevator.

In the sheet feeder according to the present invention, when large amounts of sheets is set, which exceed a set capacity of the sheet at a stop position of the sheet container, the height of the sheets exceed an appropriate carrier level (height) of the sheet carrier and a carrying jam or the like may be caused, and in this case, it is possible to move down the height of the sheet carrier to the appropriate carrier level. In addition, it is possible to add the sheet by moving down it under the appropriate carrier level.

In the sheet feeder according to the present invention, the predetermined position also includes the lowest position of the elevation range of the sheet container, and the sheet feeder further includes a display for displaying a guidance for performing the carrier processing of the sheet to be carried in plural times in the case that the detector detects that the uppermost layer of the sheet is higher than the standard position and the sheet container is located at the lowest position when the sheet is contained in the sheet container.

In the sheet feeder according to the present invention, when the sheet container stops at or reaches the lowest position and further, large amounts of sheets exceeding the set capacity of the sheet is set, guidance of a processing mode for processing the sheets in plural times is displayed on a display. Therefore, how to process a sheet bundle exceeding the capacity of the sheet container can be easily understood by the user, so that the efficient processing for the sheet bundle exceeding the capacity can be selected and can be processed.

The sheet feeder according to the present invention includes a sheet container for containing a plurality of sheets in a stacked manner, an elevator for moving up/down the sheet container, a sheet carrier for carrying an abutted sheet to a carrier path when the sheet container is moved up by the elevator, a detector for detecting that the sheet container is located at a predetermined position, and a storage unit for storing the operation state when a power source is turned off, wherein control is made if a position of the sheet container is maintained or elevated with reference to the stored contents of the storage unit when the power source is turned on.

In the sheet feeder according to the present invention, on the basis of the information whether or not the sheet feeder is normally powered off before powering on or whether or not the state upon powering on is different from the state upon powering off, the elevation operation of the sheet container is controlled. Therefore, the position of the sheet container after powering on can be reliably controlled or can be stably controlled without performing the unnecessary operation, and further, it is possible to easily set the sheet in the sheet container.

The sheet feeder according to the present invention includes a sheet detector for detecting the sheet contained in the sheet container; wherein when the sheet detector detects that no sheet remains in the sheet container, the controller controls the elevator so that the sheet container is located at a predetermined position.

In the sheet feeder according to the present invention, for example, in the case that the processing for the set sheet has been completed and no sheet remains, the sheet container is returned to the position (the height) that has been already set. Therefore, the processing for the following sheet can be started immediately and further, the necessary time for processing for the following sheet can be shortened.

In the sheet feeder according to the present invention, the powering on includes powering on again when the sheet feeder is returned from an energy saving mode.

In the sheet feeder according to the present invention, when the sheet feeder is lost in an energy saving mode or the like, the sheet feeder can be returned from the energy saving mode by powering on, so that also in this case, it is possible to make the operation time shorter.

An image reading apparatus according to the present invention includes a sheet feeder according to any one of the above-described inventions, and an image reader for reading the image on the sheet carried by the sheet carrier.

According to the image reading apparatus, by reducing the wasteful operation upon powering on, the operation time can be shortened and, further, an image on the sheet carried by the sheet carrier can be read.

An image forming apparatus according to the present invention includes a sheet feeder according to any one of the above-described inventions, an image reader for reading an image of a sheet carried by the sheet carrier, and an image forming unit for forming the image read by the image reader on paper.

According to the image forming apparatus, by reducing the wasteful operation upon powering on, the operation time can be shortened and, further, the image read by the image reader can be formed on the sheet.

The above and further objects and features of the invention will more fully be apparent from the following detailed description with accompanying drawings.

DETAILED DESCRIPTION OF THE INVENTION

Embodiments of the present invention will be described in detail with reference to the drawings below.

Figure 1:
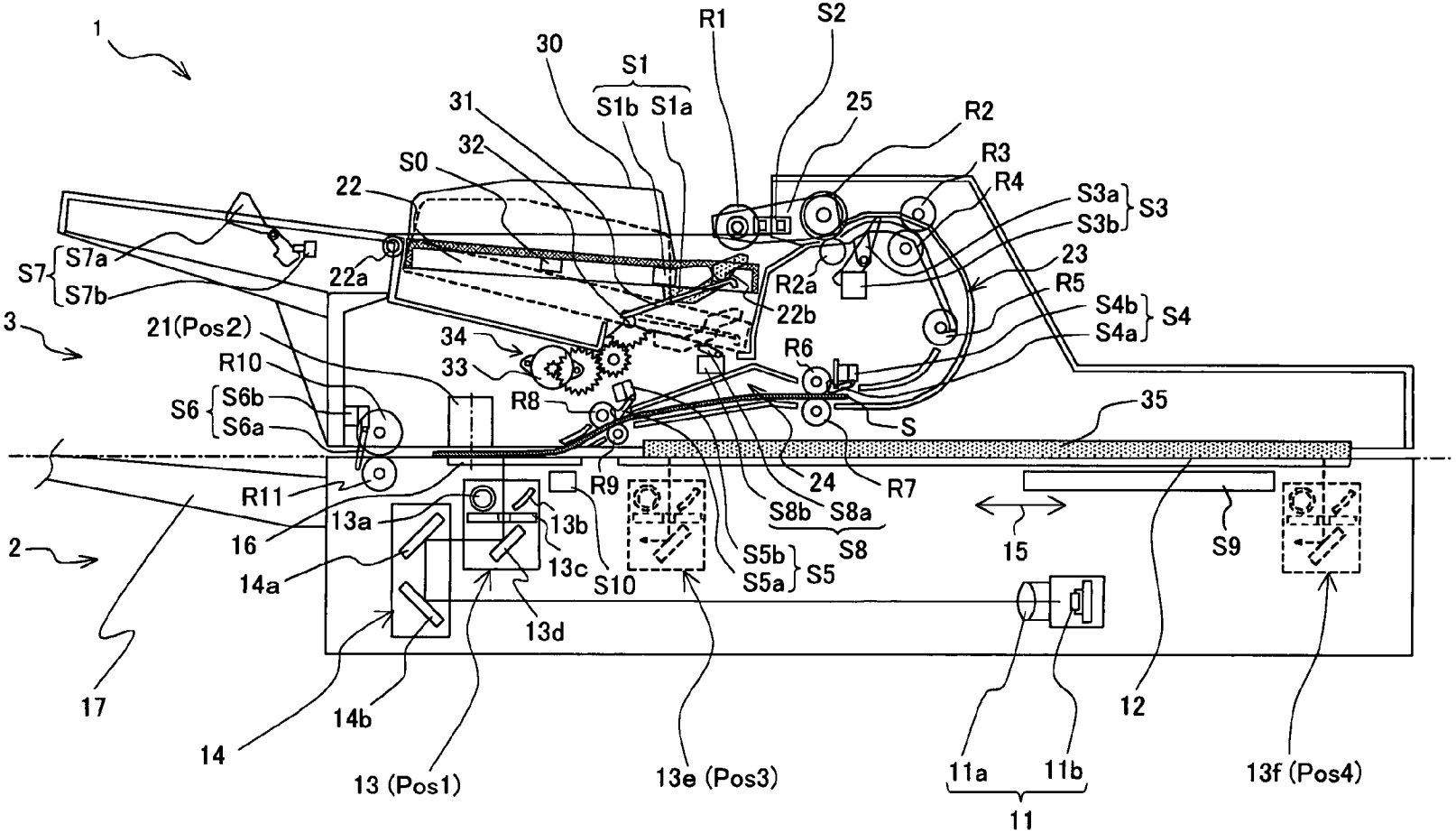
FIG. 1 is a longitudinal sectional view showing an entire structure of an image reading apparatus according to the present invention.

FIG. 1 is a longitudinal sectional view showing an entire structure of an image reading apparatus 1 of an embodiment according to the present invention. This image reading apparatus 1 is briefly structured by an optical system 2 and an ADF (Automatic Document Feeder) 3 that is arranged above the optical system 2, and this image reading apparatus 1 is used as a scanner apparatus (an image reading apparatus) capable of reading images on the opposite faces of a document for a copying machine and a facsimile machine the like.

The optical system 2 is provided with a CCD (Charge Coupled Device) reading unit 11 as a first reader, a light source unit 13, and a mirror unit 14. By using the light source unit 13 and the mirror unit 14, the image of the document mounted on a document table (platen glass) 12 and is supported on a plain is made to be read by the CCD reading unit 11 that is provided on a predetermined position. The CCD reading unit 11 is provided with an image formation lens 11*a* and a CCD 11*b*, and focuses a reflection light from the document passing through respective parts (to be described later) on the CCD 11*b* via the image formation lens 11*a*.

The light source unit 13 is provided with an exposure lamp 13*a*, a reflector 13*b* of a concave side condensing illumination light for reading to be irradiated from this exposure lamp 13*a* on a predetermined reading position on the document table 12, a slit 13*c* only passing a reflection light from the document, and a mirror 13*d* that is arranged with its reflection side at 45° against the side of the document table 12 in order to change an optical path of the light passed through the slit 13*c* by 90°. A mirror unit 14 is provided with a pair of mirrors 14*a* and 14*b* arranged in such a manner that their reflection sides are at right angles to each other in order to further change the optical path of the light by 180°, of which optical path is changed by 90° with the mirror 13*d* of the light source unit 13.

The light source unit 13, as shown by reference numerals 13*e*, 13*f* and the like, moves in an arrow direction 15 (sub-scanning direction) in parallel with the side of the document table 12, and in the same way, the mirror unit 14 moves in the arrow direction 15 (sub-scanning direction) in parallel with the side of the document table 12. This makes it possible to read the image of the document mounted on the document table 12. In this case, assuming that a moving rate of the light source unit 13 is V, it is necessary to make a moving rate of the mirror unit 14 V/2. In addition, the light source unit 13 and the mirror unit 14 are moved by a stepping motor 42 (see FIG. 2).

In the meantime, the CCD reading unit 11 may focus the reflection light of the irradiated from the exposure lamp 13*a* from the document on the CCD 11*b* via the image formation lens 11*a* while scanning a unit of a reduced reading optical system or a unit of an equally multiplied reading optical system at a rate V, in which at least CCD 11*b*, the image formation lens 11*a* and the exposure lamp 13*a* are configured into one unit (not illustrated).

In addition, this optical system 2 is provided with a document table 16 at a position separated in a direction of sub-scanning differently from the document table 12. The light source unit 13 can read the image of one side of the document (hereinafter, this side is referred to as a front side) carried on the document table 16 with resting below this document table 16. In the vicinity of an outlet of the document carried on this document table 16, a discharge tray 17 is provided.

On the other hand, the ADF 3 is provided with a CIS (Contact Image Sensor) 21 as a second reader at a position opposed to the document table 16. The ADF 3 may, make the image of the other side of the document (hereinafter, referred to as a rear side) to be read by the CIS 21 while taking out the documents contained on a document tray 22 as a sheet container in a stacked state one by one. Therefore, the ADF 3 is further provided with various rollers R1 to R10, various detectors S0 to S8, a curved carrier path 23, and a resist skewing correction area 24. In the meantime, the CIS 21 is provided with, for example, an image sensor shaped in an array, light guiding means shaped in an array (a lens array such as a Selfoc lens) and a light source (an LED array light source or a fluorescent lamp) and the like.

Figure 2:
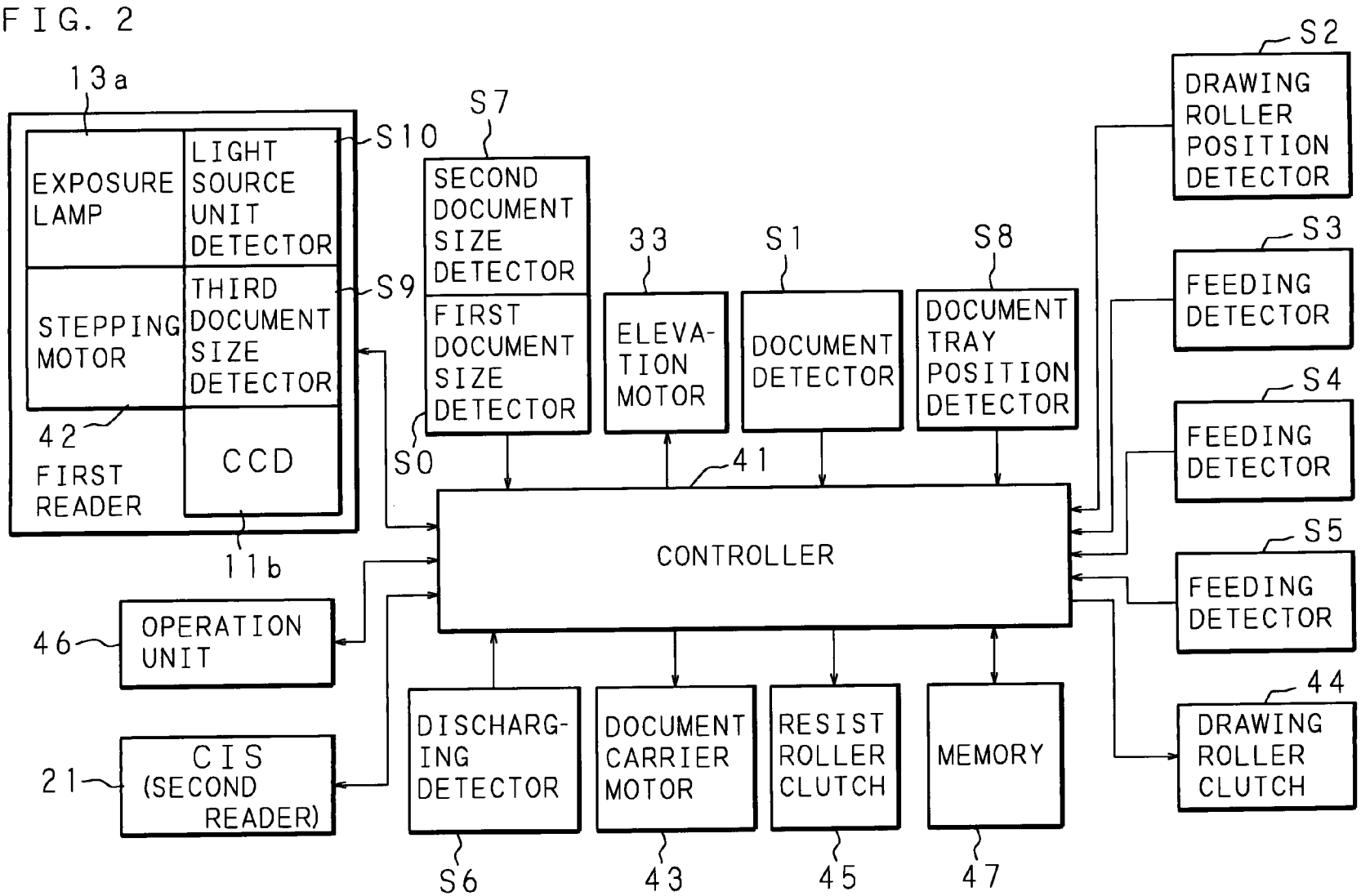
FIG. 2 is a block diagram showing a functional structure of the image reading apparatus according to the present invention.

In the meantime, various rollers R1 to R10 are driven by a document carrier motor 43 (see FIG. 2). A drawing roller clutch 44 (see FIG. 2) is connected to a drawing roller R1 as a sheet carrier and a separation roller R2 that is coupled in conjunction with this drawing roller clutch 44 by transmission means such as a belt, and a resist roller clutch 45 (see FIG. 2) is connected to one of the resist rollers R8 and R9, respectively. If these clutches 44 and 45 are blocked off by control of a controller 41 (see FIG. 2), a driving force of the document carrier motor 43 (see FIG. 2) is transmitted to or blocked off the drawing roller R1, the separation roller R2, and the resist rollers R8 and R9.

A document tray 22 is electrically operated and when detecting that the document is set by an optical document detector S1 having an actuator S1*a* and a sensor body S1*b*, a start key is lighted and the apparatus gets into standby state. Further, in the case that the document tray 22 starts to move up at a predetermined timing, the document at the uppermost layer of the mounted document bundle pushes up a drawing roller R1 that is supported by an arm 25 with freely elevated and displaced, and a drawing roller position detector S2 as a position detecting unit detects that this drawing roller R1 is displaced (specifically, it is pushed up), stopping the document tray 22 to move up once, the height of the document tray 22 may be maintained as it gets into a standby sate. The drawing roller position detector S2 (the position detector) for detecting the height of the drawing roller R1 (the sheet carrier) has the function of detecting whether or not the height of the uppermost layer of the document (sheet) is located at an appropriate carrier level and it detects whether or not the document tray 22 is located at the highest position.

In the meantime, in the case of setting the document in the document tray 22 and rising the document tray 22 on standby, if the document tray 22 is left for predetermined hours with no signal to start reading inputted therein, the document tray 22 may be remained on a standby as it is. However, it is preferable that the document tray 22 moves down at a predetermined height once on standby so as to prevent transformation of the drawing roller R1.

If a document feeding start signal is inputted, when the document tray 22 is put on standby down below, rising the document tray 22 is performed till the drawing roller position detector S2 detects the drawing roller R1 and, then, the drawing roller R1 is rotationally driven and the documents on the uppermost layer of the document bundle are sequentially fed. At a downstream side of the drawing roller R1, the separation rollers R2 and R2*a* are arranged. The drawing roller R1 is supported by the arm 25 which is supported rotatably around a rotation shaft of the separation roller R2. Then, the drawing roller R1 may contact the document on the uppermost layer that is set on the document tray 22 by its own weight or an energization force. In addition, the drawing roller R1 is prevented from being moved down more than necessary by a stopper (not illustrated).

A convex portion is formed on a side of the arm 25. By detecting this convex portion by the drawing roller position detector S2 including an optical sensor or the like, it is possible to detect the height of the drawing roller R1 from a swing angle of the arm 25. In the meantime, according to the preset embodiment, providing the convex portion on the arm 25 and providing the drawing roller position detector S2 thereon, this drawing roller position detector S2 may directly detect the height of the drawing roller R1 in the present embodiment; however, the drawing roller position detector S2 may be provided separated from the arm 25. In this case, by using movable coupling means, the height of the arm 25 may be detected.

On the separation roller R2, the separation roller R2*a* provided with a torque limiter (in place of this, a friction pat is available) is provided opposed therewith. Accordingly, even if the plural documents are taken in by the drawing roller R1, it is evaded that the document at the uppermost layer contacting the drawing roller R1 is only taken in and the documents are doubly fed by separation rollers R2 and R2*a* and this makes it possible to reliably separate one document. In the meantime, it is detected by a feeding detector S3 having an actuator S3*a* and a sensor body S3*b* whether or not the document is reliably separated and fed by the separation rollers R2 and R2*a*. Then, the document is carried to a curve carrier path 23 at a downstream side at a predetermined timing.

In the curved carrier path 23, a feeding detector S4 that has an actuator S4*a* and a sensor body S4*b* and detects discharge of the document from the curved carrier path 23 may detect whether or not the documents are carried by carrier rollers R3 to R7 reasonably. The curved carrier path 23 has a curvature capable of carrying any kinds of document stably. Specifically, the curved carrier path 23 is configured with a curvature capable of smoothly carrying the most thick, namely, most elastic document from among the readable documents.

Then, the document discharged from the curved carrier path 23 is carried to the resist skewing correction area 24. When a front end of the document is detected by a feeding detector S5 that is arranged before the resist rollers R8 and R9 set in the vicinity of the outlet of the resist skewing correction area 24, the front end of the document is crashed against a seam of the resist rollers R8 and R9 by a carriage force from the upstream side over a predetermined time with the resist rollers R8 and R9 stopped, and thereby, resist and skewing correction of the document are carried out. In the meantime, the feeding detector S5 includes an actuator S5*a* and a sensor body S5*b*.

The resist skewing correction area 24 is a segment from the last carrier roller pair R6, R7 of the curved carrier path 23 to the resist roller pair R8, R9. In this resist skewing correction area 24, a document S becomes approximately a straight line between these carrier rollers R6, R7 and the resist rollers R8, R9 and the document becomes free as much as possible from a guide surface of the carrier path so as to perform the above-described resist and skewing correction of the document. In the meantime, a distance between the carrier rollers R6, R7 and the resist rollers R8, R9 may secure at least a length in a carrier direction of the smallest document among the documents that can be processed by the document feeder. In other words, the more a rear end portion of the document staying within the curved carrier path 23 is shorter, the more the resist and the skewing correction of the document can be performed smoothly.

The document applied with the resist and the skewing correction in the resist skewing correction area 24 restarts to be carried at a predetermined timing; this document is carried to a first reading position Pos1 for exposure-scanning a front side of the document, and then, the document passes through a second reading position Pos2 for exposure-scanning a rear side of the document. The light source unit 13 and the CIS 21 face to the first reading position Pos1 and the second reading position Pos2, respectively.

Thus, the document having read its front side or both front and rear sides may be discharged on the discharge tray 17 that is supported lower than a document discharge position of a side of the document reading apparatus 1 by the discharge rollers R10 and R11 (however, the discharge roller R11 is provided at the side of the optical system 2). A discharging detector S6 having an actuator S6*a* and a sensor body S6*b* may detect whether or not the discharge operation of the document to this discharge tray 17 is checked.

Sequentially repeating the above-described operations till the documents set on the document tray 22 are all removed, all of the completely read documents are sequentially discharged on the discharge tray 17.

In the meantime, since the height of the document bundle is gradually lowered when the documents on the document tray 22 are sequentially fed, by rising the document tray 22 for a moving down position of the drawing roller R1, the document tray 22 is controlled so that the uppermost side of the document bundle and the drawing roller R1 can always maintain a predetermined height. Therefore, the document tray 22 can be swung around a supporting point 22*a*; however, the document tray 22 can rise by pushing up a rib 22*b* that is provided at an end at the opposite side of the supporting point 22*a* by an elevation plate 31 and, in addition, a rib 22*b*, namely, the document tray 22 falls down by moving down the elevation plate 31 on the contrary. The end at the opposite side of the rib 22*b* of the elevation plate 31 is secured to a plate supporting shaft 32, and this plate supporting shaft 32 is rotatably driven by an elevation motor 33 via an elevation mechanism 34 having a transmission member (gear) row. An elevator for moving up/down the sheet container (the document tray 22) is configured by these elevation motor 33, elevation mechanism 34 and the like.

In the vicinity of the resist skewing correction area 24, a document tray position detector S8 as a position detector is provided to detect the lowest position of the document tray 22. This document tray position detector S8 has an actuator S8*a* and a sensor body S8*b*. The document tray position detector S8 (the position detector) may detect whether or not the document tray 22 (the sheet container) is located at the lowest position.

A position of the document tray 22 on standby is maintained by controlling the driving of the elevation motor 33 of the elevation mechanism 34 by a controller 41 (see FIG. 2) on the basis of a detection signal of the drawing roller position detector S2. This position of the document tray 22 on standby can be optionally set by the operation of an operation unit 46 (see FIG. 2) in accordance with the number of the documents frequently set in the document tray 22 in a daily general usage state, and a service person or the user can set it in advance.

Further, as described above, the document tray 22 can be elevated and displaced in the range between a height position at the inlet side of the curved carrier path 23 to be naturally formed by the curved carrier path 23 set capable of securing the stable carriage of the document and a height position at the outlet side thereof. In the case that the document tray 22 moves in a lower direction, an interval between the document tray 22 and the drawing roller R1 is made larger, so that it is possible to mount a large amount of documents and, further, it is possible to sequentially feed the document by rising one sheet on the uppermost layer of a large amount of document bundles that are mounted on the document tray 22 to a position capable of being fed to the inlet of the curved carrier path 23.

In addition, the document tray 22 is provided with a document regulatory plate 30 for regulating and aligning the side of the document bundle, and the position of this document regulatory plate 30 is detected by a first document size detector S0 for detecting a wide (a length in a direction orthogonal to a direction of feeding a document) of the document. In the meantime, the document tray 22 is also provided with a second document size detector S7 having an actuator S7*a* and a sensor body S7*b* for detecting a length of the document (a length of a direction of feeding a document). By these first and second document size detector S0 and S7, the size of the document mounted on the document tray 22 is detected and, on the basis of this detection result, a printer sheet upon forming an image or the like is performed and this detection result is also used for controlling a height of the document tray 22 by the controller 41 (see FIG. 2).

On the other hand, upon reading the document on the document table 12, the light source unit 13 may move a certain distance in accordance with the document size that is detected by a third document size detector S9 for detecting the size of the document that is mounted on the document table 12 in a direction from a position Pos3 (a start position of the light source unit 13 upon reading the static document, hereinafter, referred to as a third position) to a position Pos4 (a return position of the light source unit 13 upon reading the largest document, hereinafter, referred to as a fourth position) in FIG. 1.

On the contrary, upon reading the carried document, the light source unit 13 stops at the first reading position Pos1 (at a position of the light source unit 13 upon reading a traveling document). In addition, the light source unit 13 defines one of a middle position between the third position Pos3 and the fourth position Pos4 and a middle position between the third position Pos3 and the first reading position Pos1 as a home position on the basis of the detection result of a light source unit detector S10 for detecting the position of the light source unit 13. Accordingly, when the light source unit 13 is not used, namely, on standby, the light source unit 13 stops at this home position.

In the meantime, in order to read the document mounted on the document table 12, in the ADF 3, a portion at a back side of the image reading apparatus 1 (a back side in FIG. 1) is rotatably supported by a hinge (not illustrated) that is provided between the ADF 3 and the optical system 2. The ADF 3 rotates upward against the document table 12 and opens around this hinge as a rotation supporting point. In other words, rotating upward and opening the ADF3, the upper side of the document table 12 of the image reading apparatus 1 can be released from a front side in FIG. 1, and this makes it possible; to set a document that is not a sheet type and cannot be carried by the ADF 3, for example, a document such as a book type or the like on the document table 12. In the meantime, on a bottom surface of the ADF 3, namely, on a surface contacting the document table 12, a document mat 25 that is made of an elastic material is provided opposed to the document table 12. In addition, this opening/closing state of the ADF 3 may be detected by an ADF opening/closing detector 28 that is provided at the side of the optical system 2.

The image reading apparatus 1 that is configured as described above can read the document in three modes, namely, a static reading mode, a traveling reading mode, and a double-sided reading mode. The static reading mode serves to read the document such as a book and, in this mode, the image reading apparatus 1 may read the document mounted on the document table 12 by means of the CCD reading unit 11 while scanning the light source unit 13 and the mirror unit 14 in a direction indicated by the arrow 15.

In addition, both of the traveling reading mode and the double-sided reading mode serve to read the documents set on the document tray 22 while feeding them automatically by the ADF 3 one by one. In the meantime, in the traveling reading mode, by using the CCD reading unit 11, and in the double-sided reading mode, by using both of the CCD reading unit 11 and the CIS 21, the documents are read respectively.

In the meantime, according to the present embodiment, the largest number of the documents capable of being set on the document tray 22 is for example about 200 in a normal thickness of a copying sheet.

FIG. 2 is a block diagram showing a functional structure of the image reading apparatus 1 according to an embodiment of the present invention. In the meantime, in FIG. 2, the identical reference numerals are given to the identical or corresponding parts as or to the configuration shown in the above-described FIG. 1 and their explanations are herein omitted.

To the controller 41 realized by a microcomputer or the like, the detection results of the first and second document size detectors S0, S7 for detecting the size of the document set on the document tray 22, and the third document size detector S9 for detecting the size of the document set on the document tray 12 are supplied. The controller 41 may change over control of a sheet to be used and timing on the basis of the detection results of these document size detectors S0, S7 and S9.

Upon reading the document by using the CCD reading unit 11, the controller 41 may drive and control the stepping motor 42 to move the light source unit 13 and the mirror unit 14 as described above, and further, the controller 41 may control the exposure lamp 13*a* and the CCD 11*b* in accordance with the position of the light source unit 13 that is detected by the light source unit detector S10 to read the image of the document.

On the contrary, upon reading the document by using the ADF 3, maintaining the height of the uppermost side of the document bundle set in the document tray 22 by driving and controlling the elevation motor 33 on the basis of the detection result of the drawing roller position detector S2 and carrying the document by controlling the document carrier motor 43, the drawing roller clutch 44 of the drawing roller R1, and the resist roller clutch 45 of the resist rollers R8, R9 on the basis of the detection results by the respective detectors S3 to S6 until the document detector S1 detects that all documents are removed from the document tray 22, the controller 41 may control the CCD 11*b* and/or the CIS 21 to read the image of the document.

In addition, a controller 41 may display the necessary information on an operation unit 46 that is composed of a liquid touch panel or the like and may accept the input operation to be added to the operation unit 46. Further, the controller 41 may store the state upon the former powering off (if the apparatus is normally turned off, the height of the document tray 22 on OFF) in a memory 47. In the meantime, as an example that the apparatus is not normally turned off, a case that it is powered off during the elevation operation of the document tray 22 and a case that the apparatus is lost in energy by blackout during the processing for the document may be considered.

Figure 3A:
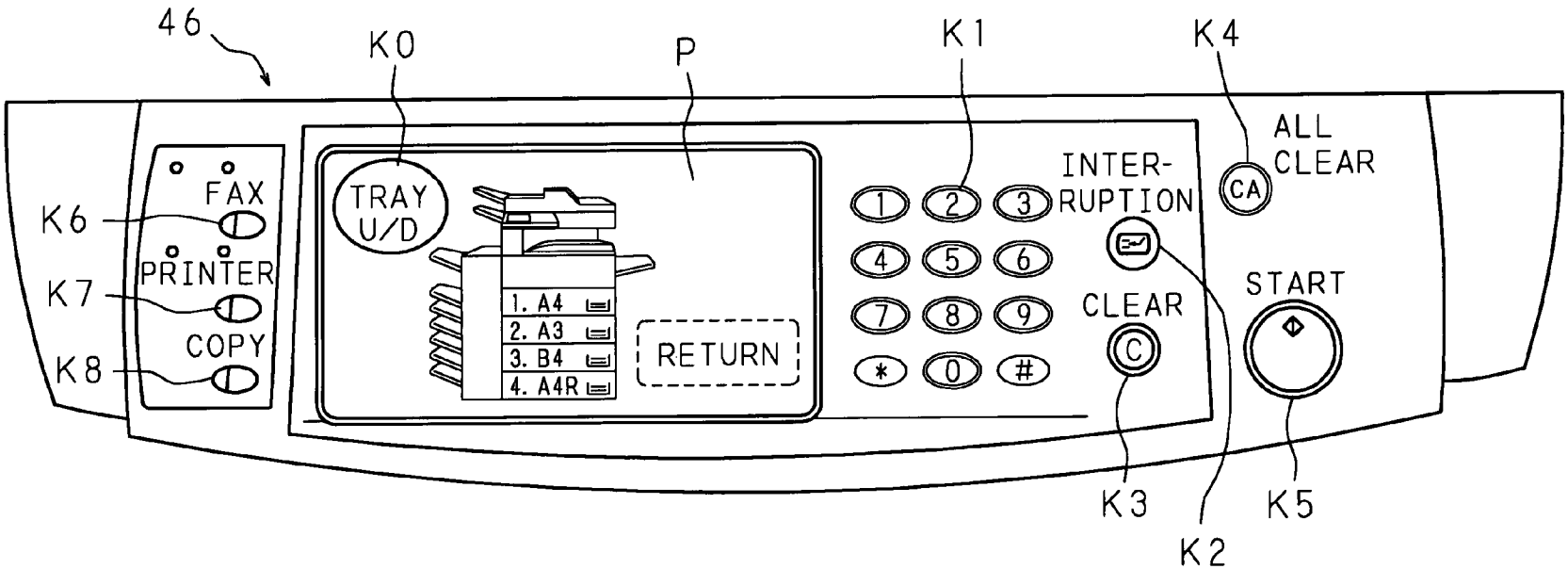
FIG. 3A and FIG. 3B are schematic views showing one constitutional example of an operation unit of the image reading apparatus according to the present invention.
Figure 3B:
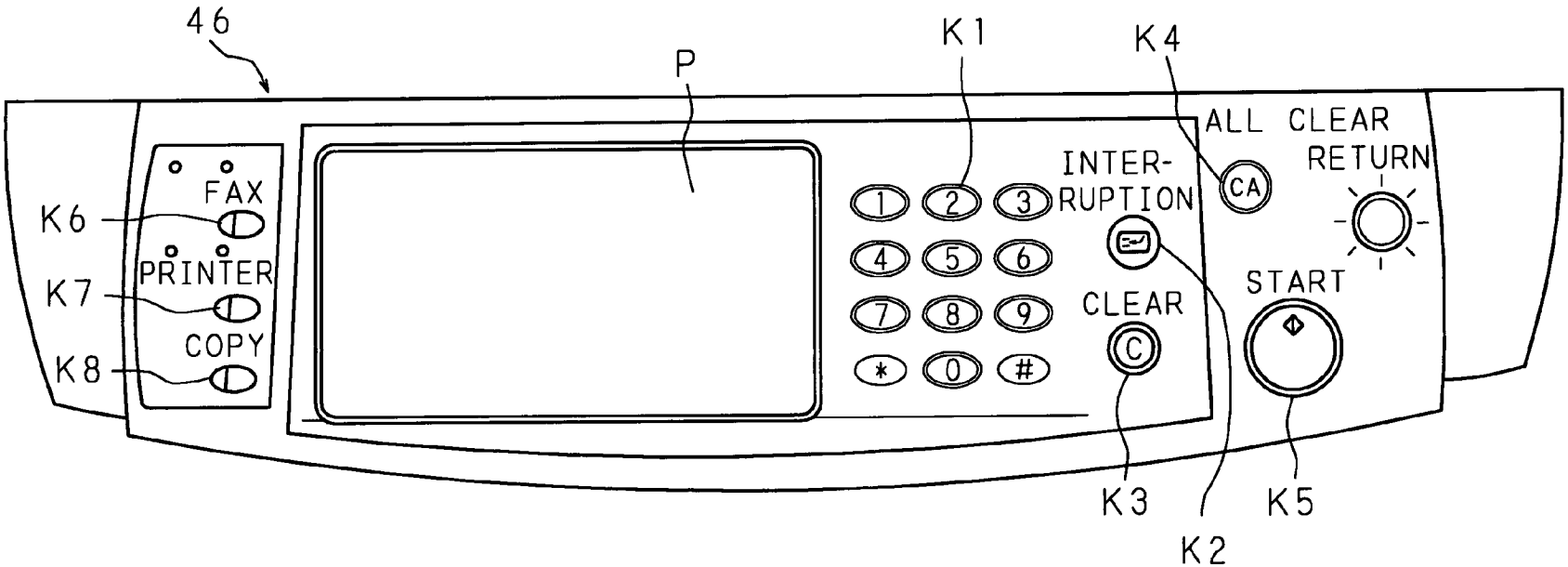

FIG. 3A and FIG. 3B are schematic views showing one constitutional example of the operation unit 46 of the image reading apparatus 1 according to the present invention. The operation unit 46 is disposed on the upper side of the image reading apparatus 1 (not illustrated in FIG. 1) and it is provided with various keys K1 to K8 and an operation panel P composed of a liquid touch panel or the like.

Among various hardware keys K1 to K8 provided to the operation unit 46, K1 is a numeric keypad for inputting numbers, K2 is a key for the interruption process, K3 is a clear key, K4 is an all clear (all release) key, K5 is a start key for starting reading of the document, K6, K7 and K8 are function changing-over keys for selecting a facsimile function, a printer function and a copy function.

Various screens are switched over and are displayed on a screen of the operation panel P. Among these screens, various software keys are arranged to set various conditions. According to an example shown in FIG. 3A, an up/down key K0 for adjusting the height of the document tray 22 is displayed on the operation panel P. If this up/down key K0 is operated in a standby state, the controller 41 may elevate and displace the document tray 22 as described later by driving an elevation motor 33, and thereby, the height of the document tray 22 can be adjusted. The elevation and displacement of the document tray 22 are carried out by a predetermined height for each operation of the up/down key K0.

In the meantime, according to the present embodiment, the up/down key K0 is disposed in the operation panel P shown in FIG. 3A, however, for example, the up/down key K0 may be provided as a push-button type switch at an appropriate position in the vicinity of the document tray 22 on the ADF 3. In addition, guidance and warning for the operation are also displayed on this operation panel P.

Figure 4:
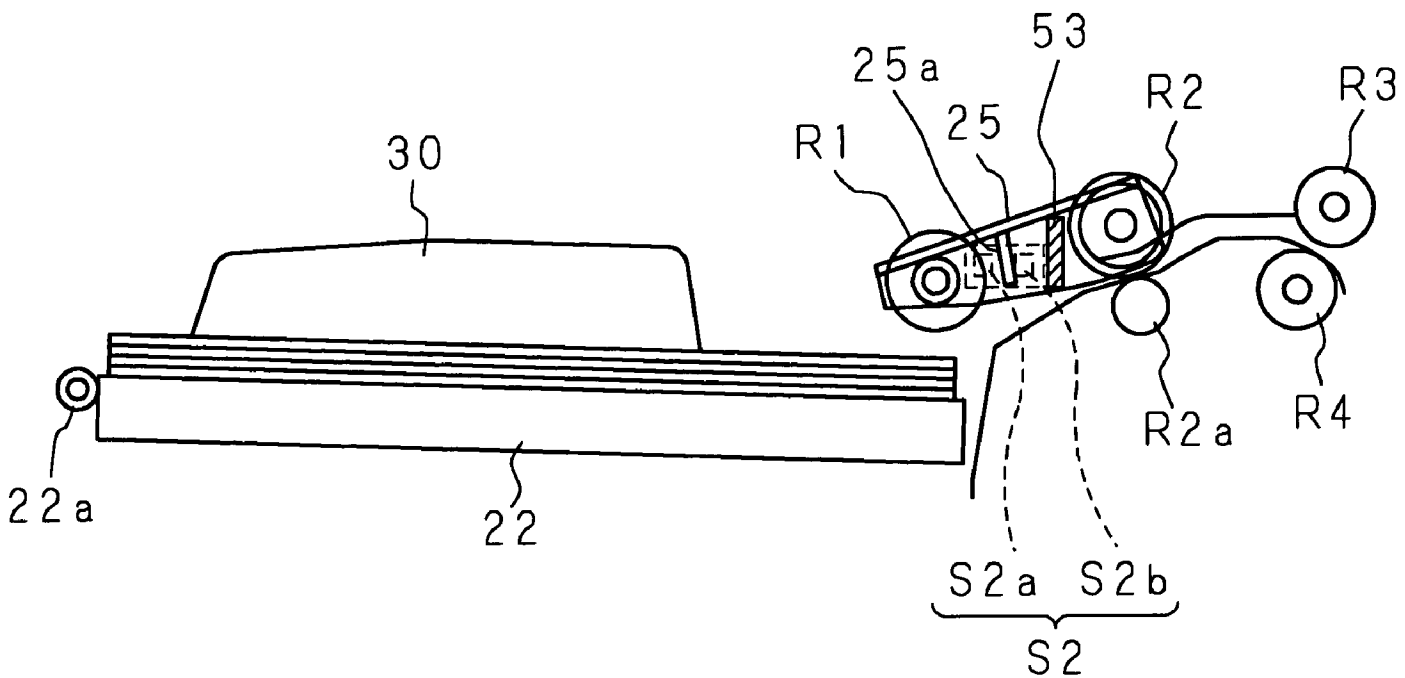
FIG. 4 is a schematic side view showing a mechanical constitutional example around a document tray for explaining the operation upon adjusting a height of the document tray of the image reading apparatus according to the present invention.
Figure 5:
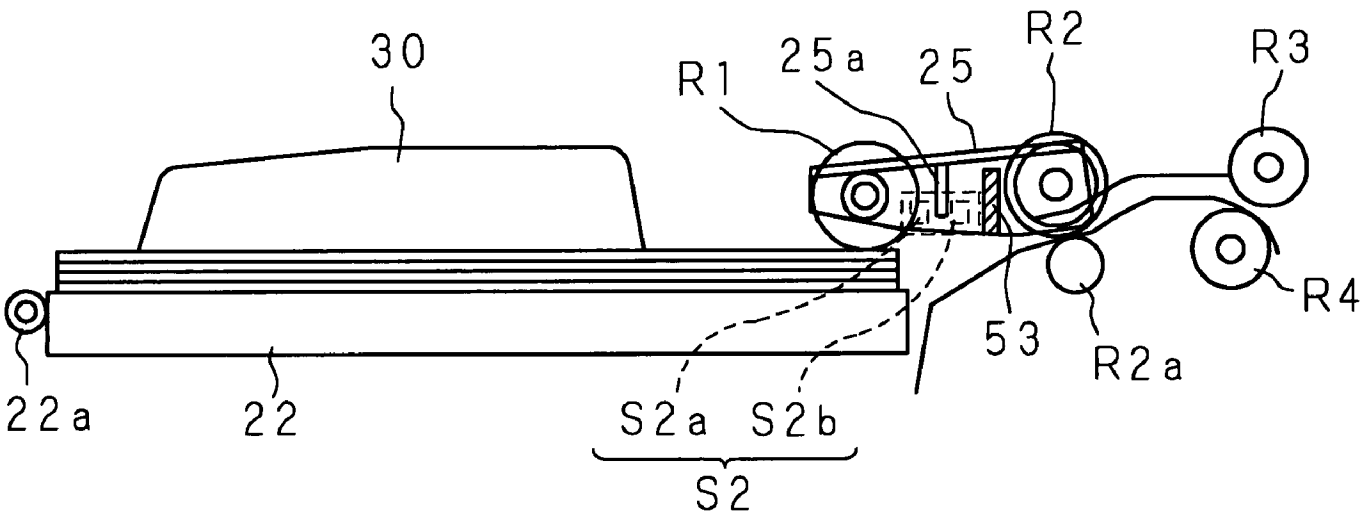
FIG. 5 is a schematic side view showing a mechanical constitutional example around a document tray for explaining the operation upon adjusting a height of the document tray of the image reading apparatus according to the present invention.
Figure 6:
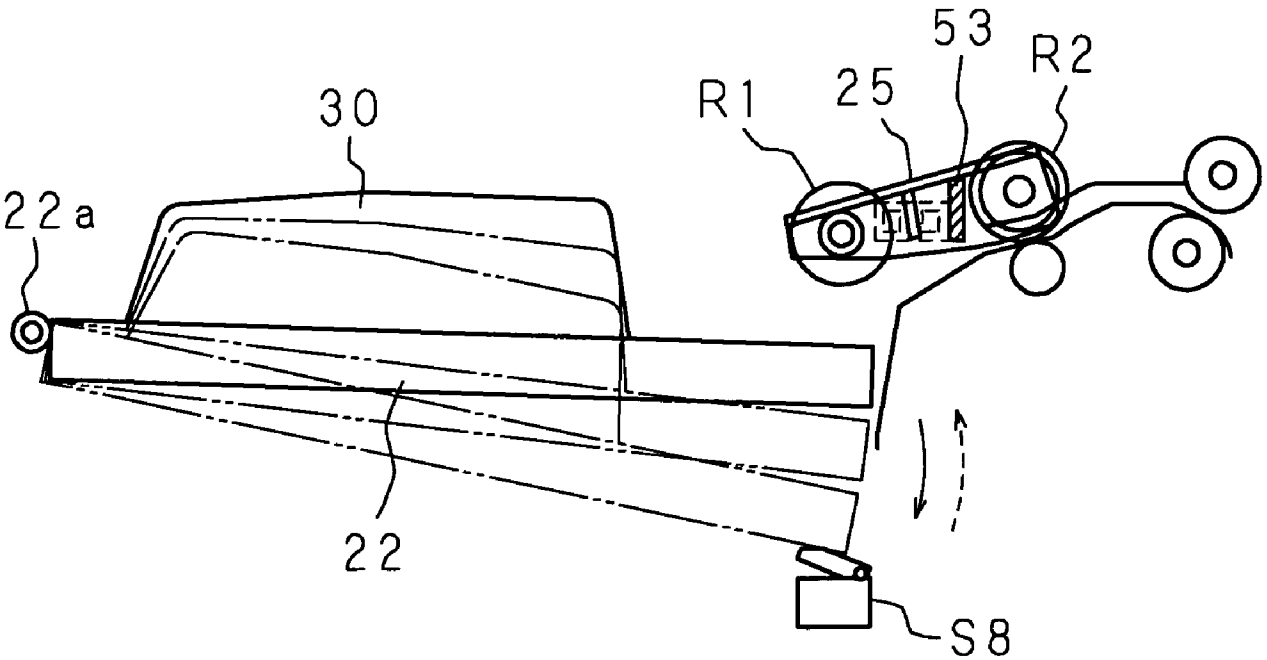
FIG. 6 is a schematic side view showing a mechanical constitutional example around a document tray for explaining the operation upon adjusting a height of the document tray of the image reading apparatus according to the present invention.
Figure 7:
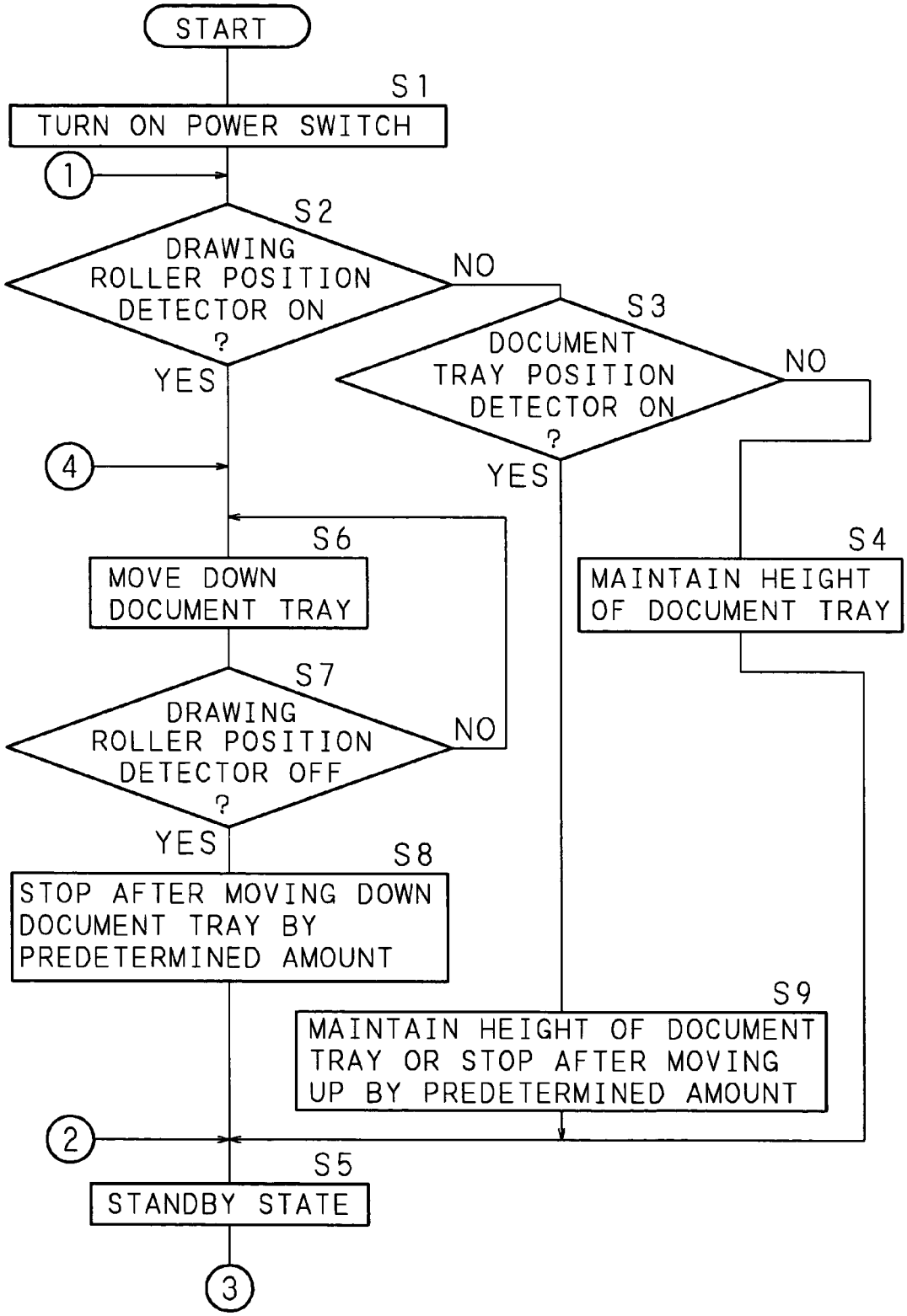
FIG. 7 is a flowchart showing a control procedure of a controller in the elevation operation of the document tray of the image reading apparatus according to the present invention.
Figure 8:
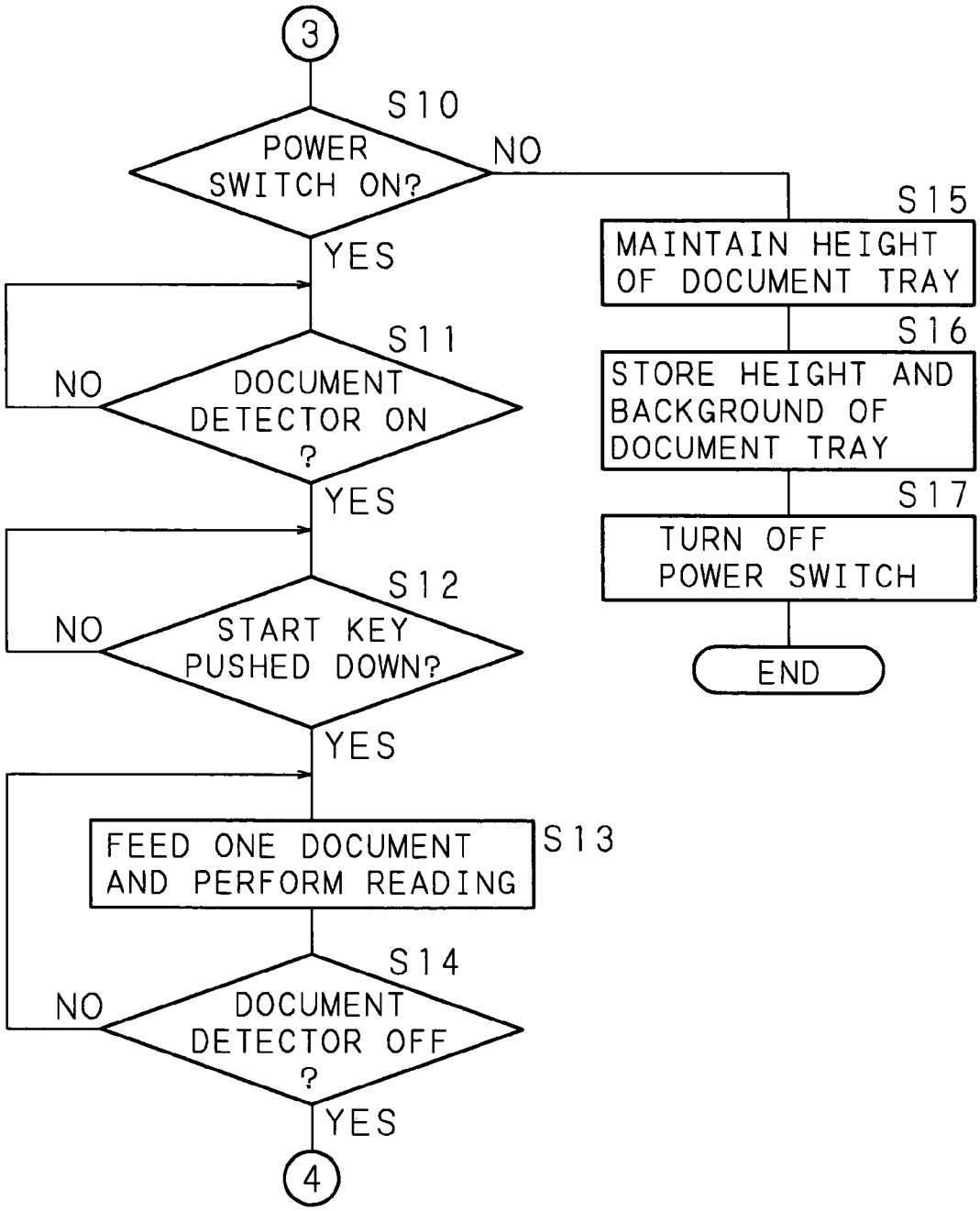
FIG. 8 is a flowchart showing a control procedure of a controller in the elevation operation of the document tray of the image reading apparatus according to the present invention.

FIGS. 4, 5 and 6 are schematic side views each showing a mechanical constitutional example around the document tray 22 for explaining the operation upon adjusting the height of the document tray 22.

For example, it is assumed that the height of the document tray 22 and the mounting amount of the document are as shown in FIG. 4, and a douser 25*a* of the arm 25 intervenes between a pair of a light emission element S2*a* and a light-sensitive element S2*b* of the drawing roller position detector S2 and a light path between two elements S2*a* and S2*b* is not formed, namely, the drawing roller position detector S2 is turned off.

Under such a state, moving upward the document tray 22, the document tray 22 is stopped under the state as shown in FIG. 5 such that the douser 25*a* of the arm 25 does not intervene between the pair of the light emission element S2*a* and the light-sensitive element S2*b* of the drawing roller position detector S2 and the light path between two elements S2*a* and S2*b* is formed, namely, the drawing roller position detector S2 is turned on. Under such state, the drawing roller R1 may contact the uppermost layer of the document bundle by its own weight or an energization force of the drawing roller R1 and the arm 25.

The document tray 22 is held at a height in accordance with the number of the documents with the highest frequency of usage, and when the document is set on the document tray 22 at this height, the front end of the document may abut against the drawing roller R1 so that the document cannot be set correctly. In such a case, the user may operate the up/down key K0. By the operation of the up/down key K0, as shown in FIG. 6, for each operation, the document tray 22 moves down step by step, and when the operation of the up/down key K0 is performed after the document tray 22 reaches the lowest position, the document tray 22 will return to the height in accordance with the number of the documents with the highest frequency of usage. Depending on such operation, it is possible to set the document tray 22 at the height in accordance with the number of the documents to be set.

In the meantime, the document tray 22 may be moved down step by step by a predetermined height for each operation, however, differently from this, during the operation of the up/down key K0 (for example, the up/down key has been continuously pushed down), the document tray 22 may be moved down in a single step. In such a case, it is possible to set the height of the document tray 22 in accordance with the number of the documents with a high degree of accuracy. In addition, the document tray 22 may be moved down to the lowest position by one operation of the up/down key K0. Further, the key to operate elevation of the document tray 22 is not limited to the up/down key K0 and for example, this elevation operation function may be provided to the all release key K4.

The elevation operation of the document tray 22 is realized by control of the controller 41; and, FIGS. 7 to 10 are flowcharts showing a control procedure by the controller 41. Hereafter, with reference to these flowcharts, the operation of the image reading apparatus 1 according to the present invention that is structured as described above will be described below.

At first, when a power switch (not illustrated) is turned on (step S1), the controller 41 determines whether or not the output of the drawing roller position detector S2 is ON, namely, whether or not the document tray 22 is located at the highest position and a light path between the elements S2*a* and S2*b* is formed (step S2). In the case that the output of the drawing roller position detector S2 is not ON (S2:NO), the controller 41 determines whether or not the document tray position detector S8 is ON, namely, whether or not the document tray 22 is located at the highest position (step S3).

In the case that the document tray position detector S8 is not ON (S3: NO), namely, in the case that the document tray 22 is located not at the highest position, not at the lowest position, but at a middle position, the controller 41 maintains the present height of the document tray 22 (step S4) to get into a standby state (step S5). In the case that the document tray position detector S8 is ON (S3: YES), namely, in the case that the document tray 22 is located not at the lowest position, the controller 41 maintains the present height of the document tray 22 or stops after moving up the document tray 22 by a predetermined amount (step S9) to get into a standby state (step S5). If it is detected that the document tray 22 is located at the lowest position, when a predetermined default height of the document tray 22 is set at the lowest position, or when the middle height as a default position is not set, the moving up operation of the document tray 22 is not performed.

On the other hand, when the output of the drawing roller position detector S2 is ON (S2: YES), namely, when the document tray 22 is located at the highest position, the controller 41 moves down the document tray 22 (step S6). Then, when the controller 41 detects that the output of the drawing roller position detector S2 is OFF (step S7: YES), the controller 41 stops after moving down the document tray 22 by a predetermined amount (step S8) to get into a standby state (S5).

In the meantime, the height of the document tray 22 to be decided by movement of S8 or S9 has been already set at a height selected through the operation unit 46 by a service person or a user from among a plurality of heights shown in FIG. 6 or at an arbitrary height in accordance with the number of document with the highest frequency of setting.

Subsequently, the controller 41 determines whether or not the power switch is turned on (step S10). When the power switch is turned on (S10: YES), it is determined that the optical document detector S1 is turned on (step S11: YES) and further, the start key K5 is pushed down (step S12: YES), the controller 41 feeds and carries one document from the document tray 22 into the carrier path to read the image (step S13).

This processing of S13 is sequentially repeated as long as the optical document detector S1 is turned on (step S14: NO). Then, in the case that the controller 41 determines that the optical document detector S1 is turned off (S114: YES), the procedure returns to S6.

On the other hand, when the power switch is powered off (S10: NO), the controller 41 maintains the present height of the document tray 22 (step S15). Then, storing the present height and a background of the document tray 22 in the memory 47 (step S16), the controller 41 turns the power source off (step S17).

In the meantime, when the document is set on the document tray 22 before energization, the controller 41 detects that the document is set after energization. Further, the carrier level of the document is detected by the drawing roller position detector S2, and in accordance with its detection result, the controller 41 determines if the height of the document tray 22 should be maintained or should be moved down. In this case, the moving down operation is immediately performed just after detecting the carrier level or it is performed delaying the timing slightly.

Figure 9:
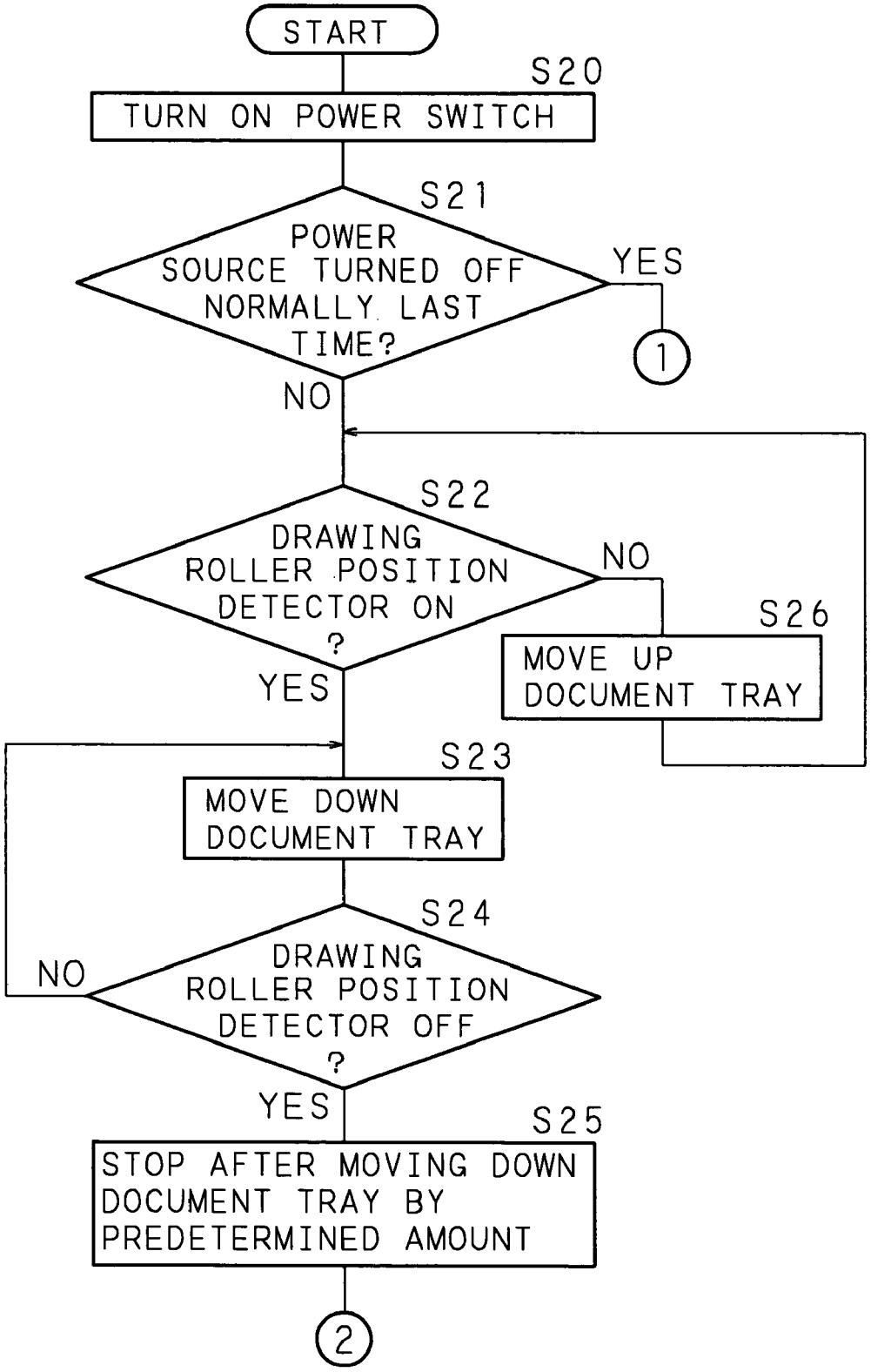
FIG. 9 is a flowchart showing a control procedure of a controller in the elevation operation of the document tray of the image reading apparatus according to the present invention.
Figure 10:
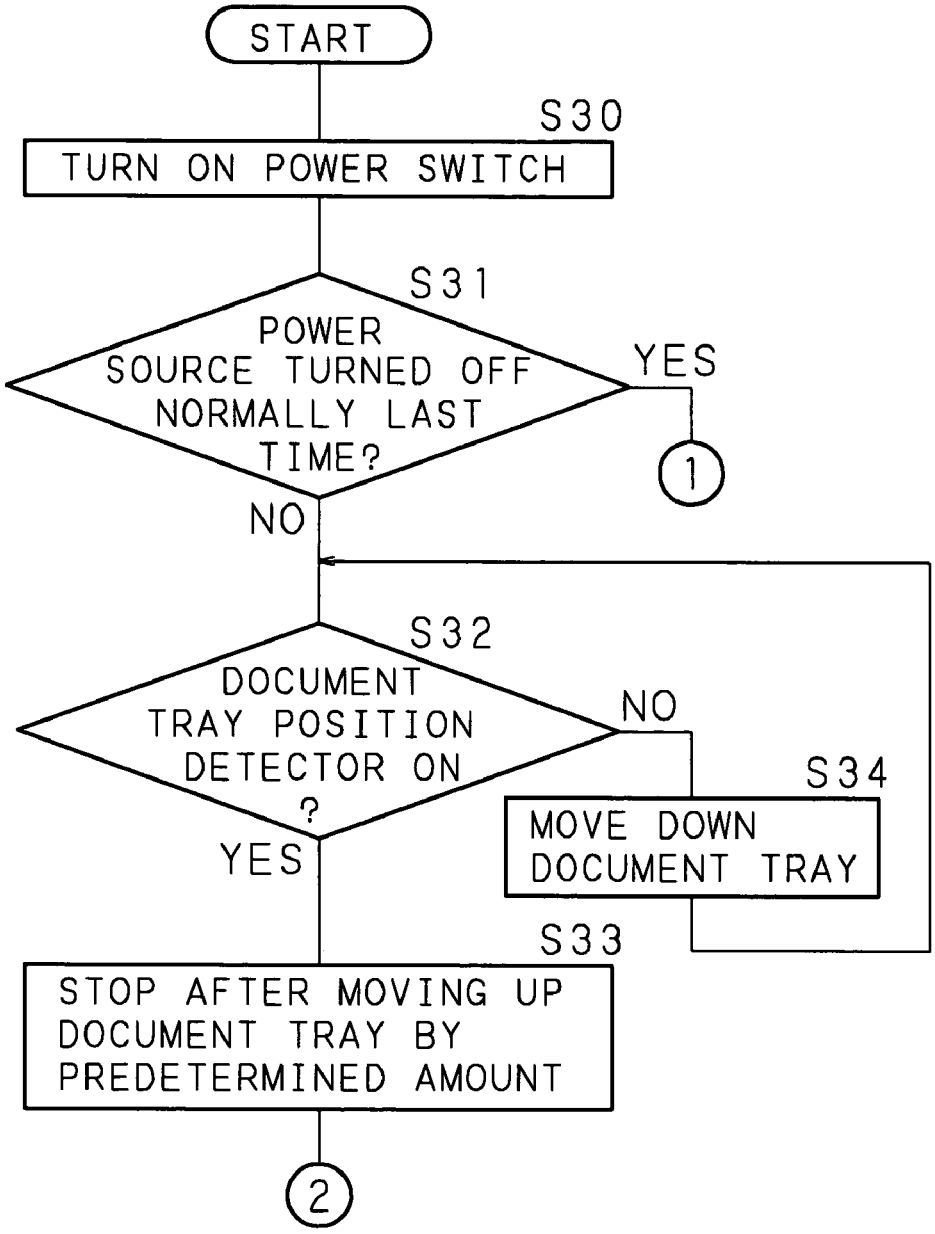
FIG. 10 is a flowchart showing a control procedure of a controller in the elevation operation of the document tray of the image reading apparatus according to the present invention.

In the next place, with reference to flowcharts shown in FIGS. 9 and 10, the control operation on the basis of the storage contents in the memory 47 will be described below. If the power switch is turned on (step S20), the controller 41 determines whether or not the power source is normally powered off on the basis of the storage contents of the memory 47 (step S21). When it is normally turned off (S21: YES), the procedure proceeds to S2. On the other hand, when it is not normally turned off (S21: NO), the controller 41 determines whether or not the output of the drawing roller position detector S2 is turned on (step S22). When the output of the drawing roller position detector S2 is not turned on (S22: NO), the controller 41 moves up the document tray 22 till the output of the drawing roller position detector S2 is turned on (step S26).

When the output of the drawing roller position detector S2 is turned on (S22: YES), the controller 41 moves down the document tray 22 (step S23). Then, if the controller 41 determines that the output of the drawing roller position detector S2 is turned off (step S24: YES), the controller 41 stops after moving down the document tray 22 by a predetermined amount (step S25) and the procedure proceeds to S5 to get into a standby state. If the output of the drawing roller position detector S2 is not turned off (step S24: NO), the procedure returns to S23.

If the power switch is turned on (step S30), the controller 41 determines whether or not the power source is normally turned off by the former processing on the basis of the storage contents of the memory 47 (step S31). When it is normally turned off (S31: YES), the procedure proceeds to S2. On the other hand, when it is not normally turned off (S31: NO), the controller 41 determines whether or not the output of the document tray position detector S8 is turned on (step S32). When the output of the document tray position detector S8 is not turned on (S32: NO), the controller 41 moves down the document tray 22 till the output of the document tray position detector S8 is turned on (step S34). As an example that the storage contents stored in the memory 47 when the power source is turned off are different from the information when the power source is turned on, a failure operation (a failure) of the detector or a case that the document tray 22 is moved by hands in maintenance during not may be considered.

When the document tray position detector S8 is turned on (S32: YES), the controller 41 stops after moving up the document tray 22 by a predetermined amount (step S33) and the procedure proceeds to S5, and the controller 41 gets into a standby state.

According to the above-described example, the embodiment applying the sheet feeder according to the present invention to the image reading apparatus is de scribed, however, the sheet feeder according to the present invention also can be applied to an image forming apparatus such as a copying machine and a printer or the like and a complex machine or the like having a scanner function, a printer function, and a facsimile function.

Figure 11:
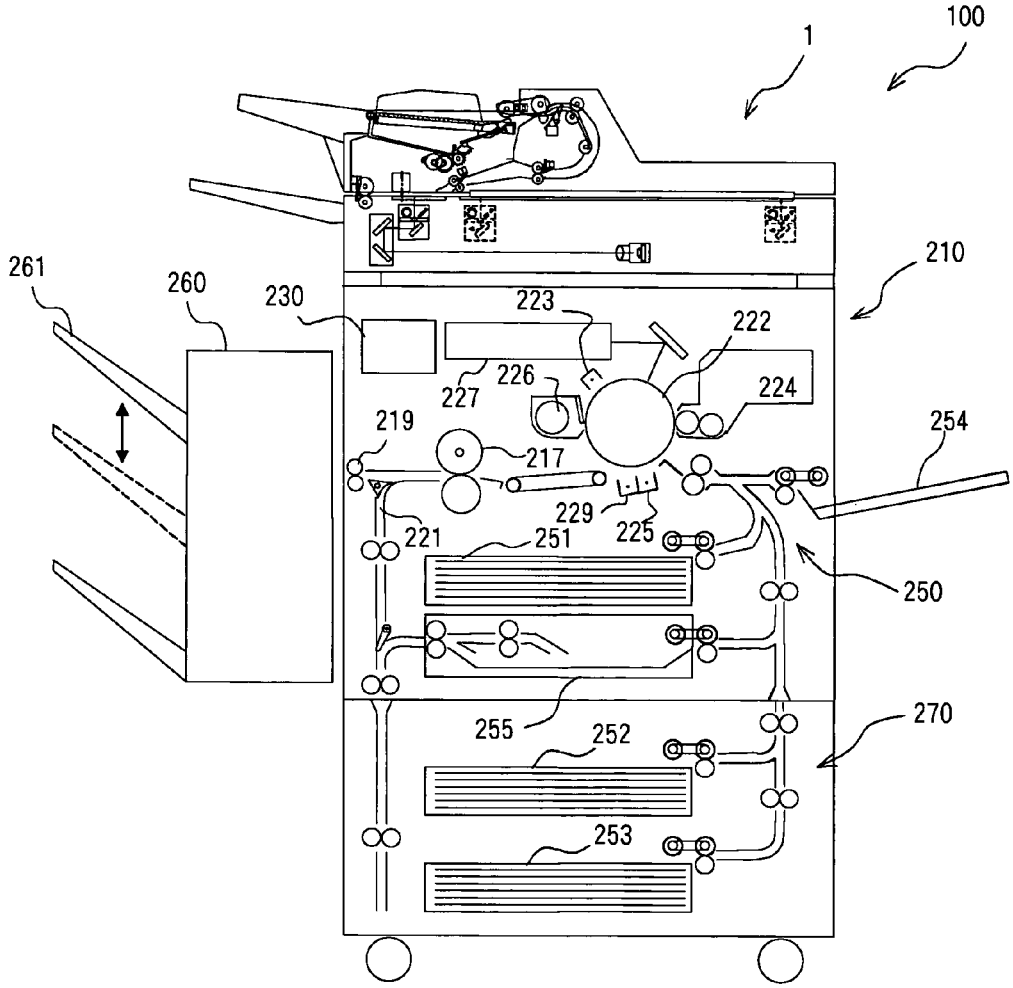
FIG. 11 is a longitudinal sectional view showing a schematic structure of an image forming apparatus according to the present invention.

FIG. 11 is a longitudinal sectional view showing a schematic structure of an image forming apparatus according to the present invention. This image forming apparatus 100 is provided with the image reading apparatus 1, an image forming unit 210 for forming an image on paper, a post-processing unit 260 for applying the post-processing to the paper having the image formed thereon, and a feeding unit 270 for feeding and carrying the paper to the image forming unit 210. The image forming unit 210 is disposed at a lower part of the image reading apparatus 1, and the post-processing unit 260 and the feeding unit 270 are disposed at a side part and a lower part of the image forming unit 210, respectively.

The image forming unit 210 has a function to form an image on the paper fed from the feeding unit 270 on the basis of the image data that is acquired by reading the image of the document by the image reading apparatus 1 or the image data that is transferred from an outer information processing apparatus (not illustrated). Specifically, the above-described image data is transmitted to an image processing unit (not illustrated) and is applied with the predetermined image processing, and then, this image data is stored in an image memory within the image processing unit once to be sequentially read at a predetermined timing and to be transferred to a laser writing unit 227 as an optical writing apparatus.

The laser writing unit 227 is configured by a semiconductor laser light source irradiating laser light in accordance with the image data that is transferred from the image memory, a polygon mirror for deflecting the laser light with a conformal rate, and a f-θ lens correcting the deflected laser light with a conformal rate so as to be deflected at a conformal rate on a photosensitive drum 222. In the meantime, according to the present embodiment, the laser writing unit 227 is used as an optical writing apparatus, however, it is possible to use an optical writing head unit of a fixed scanning type using a light emitting element array such as an LED (Light Emitting Diode) and an EL (Electro Luminescence) or the like.

Around the photosensitive drum 222, an electrification device 223 for charging the photosensitive drum 222 at a predetermined electric potential, a developing unit 224 for feeding toner to an electrostatic latent image that is formed on the photosensitive drum 222 and developing it, a transcriber 225 for transcribing a toner image that is formed on the photosensitive drum 222 on a carried paper, a static eliminator 229 for peeling off the photosensitive drum 222 from the paper, and a cleaner 226 for retrieving the remaining toner after transcribing the toner image are arranged. The paper having the image formed thereon is carried to a fixing unit 217 and the image is fixed on the paper by the fixing unit 217. The paper having the image fixed thereon is discharged to the outside by a discharging roller 219.

At the downstream side in a paper carrying direction of the discharging roller 219, a post-processing unit 260 for performing the staple processing and the inner folding processing or the like to the paper having the image formed is provided, and the paper introduced to a post-processing unit 260 is discharged on an elevation tray 261 after being provided with the predetermined post-processing. Further, the image forming unit 210 is provided with a paper tray 251 and a manual feed tray 254 for taking in an arbitrary paper from the outside. Then, the paper that is fed from the paper tray 251 or the manual feed tray 254 is carried to an image transcription position where the photosensitive drum 222 and the transcriber 225 or the like are arranged by a paper carrier 250.

In addition, at the downstream side in a paper carrying direction of the fixing unit 217, a switchback path 221 to be used upon forming an image on a rear side of the paper is provided. The paper that is inverted by the switchback path 221 is fed to a unit 250 for carrying a paper again through a double-sided unit 255. In the meantime, the switchback path 221 and the double-sided unit 255 are used not only upon forming images on the double sides of the paper but also upon inverting a front surface and a rear surface of the paper and discharging it.

The feeding unit 270 arranged on the lower part of the image forming unit 210 is provided with a plurality of paper cassettes 252 and 253 connected to the paper carrier 250 of the image forming unit 210 to contain a large amount of the paper having different sizes. On the image forming apparatus 100, a controller 230 is mounted, which operates the above-described respective parts in liaison with each other, in order to form an image on the paper fed from the feeding unit 270 to the image forming unit 210 on the basis of the image of the document that is read by the image reading apparatus 1.

Here, the processing of a large amount of documents exceeding the maximum set amount of the document tray 22 will be described. In the case of the document bundle with the small number of documents upon setting the document bundle on the document tray 22, all documents can be set in the document tray 22 by one setting. However, in the case of the large number of documents, the setting processing cannot be performed by one setting and the documents should be set in plural times.

In such a case, dividing the document bundle into plural bundles with each capacity not more than the maximum set amount; setting, feeding and carrying the divided document bundles on the document tray 22 separately; and reading them, an image forming apparatus will print them in a mass. For example, storing the read images of the divided document bundle separately in an image memory, the image formation processing is carried out for them after reading all documents. It is a matter of course that the image formation may be performed continuously while adding the sheets.

As described above, it is noted that the large amount of the documents is set, of which documents need the plural times of processing, when the drawing roller position detector S2 detects that the sheet set in the document tray 22 is too high and the document tray position detector S8 detects that the document tray 22 reaches to the lowest position. In such a case, the contents of the mode for performing the processing divided into the plural times are noticed to the user by displaying it on the operation panel P of the operation unit 46.

As described above, according to the present invention, in the case that the sheet container is located not at the highest position, not at the lowest position, but at a middle position when the power source is turned on, the sheet container is maintained at the present position without elevating the sheet container, so that the wasteful operation (the initial operation) can be reduced so as to make the operation time shorter and the efficient sheet processing can be performed.

In addition, according to the sheet feeder of the present invention, since the sheet container is moved down when the sheet container is located at the highest position, it is possible to easily set the sheet in the sheet container.

In addition, according to the sheet feeder of the present invention, since the sheet container remains at a position as it is or sheet container is moved up when the sheet container is located at the lowest position, it is possible to perform the setting processing of the sheet till the initial operation has been completed. Alternatively, it is possible to reduce a necessary time of the operation in accordance with the operation start signal after setting the sheet.

In addition, according to the sheet feeder of the present invention, in the case that the sheet container is located at a higher middle position, by operation the operation unit (the up down key), the sheet container can be moved down and many sheets can be easily processed.

According to the sheet feeder of the present invention, since the sheet container is moved down to be lowered to the appropriate carrier level of the sheet member when a large amount of sheets exceeding the set capacity of the sheet at a stop position of the sheet container is set, it is possible to prevent occurrence of the carrying jam or the like.

According to the sheet feeder of the present invention, since the sheet container is located at the lowest position and the guidance of the processing mode for processing the sheet in plural times is displayed on the display (the operation panel P) when a large amount of sheets exceeding the set capacity is set, the user can select the efficient processing for the sheet bundle exceeding the maximum capacity.

According to the sheet feeder of the present invention, since the elevation operation of the sheet container is controlled on the basis of the information if the power source is normally turned off before powering on or if the state upon powering on is identical with or different from the state upon powering off, the sheet feeder can be stably controlled reliably or without performing the unnecessary operation and further, the sheet can be easily set in the sheet container.

According to the sheet feeder of the present invention, since the sheet container is returned to the position (height) that has been already set when no sheet remains in the sheet container, the processing for the following sheet can be immediately started and further, it is possible to reduce a necessary time of the processing for the following sheet.

According to the sheet feeder of the present invention, since the apparatus can be returned from the energy saving mode by powering on when the apparatus is lost in an energy saving mode or the like, also in this case, it is possible to reduce the operation time.

Since the image reading apparatus and the image forming apparatus are provided with the above-described sheet feeder, by reducing the wasteful operation when the power source is turned on, the operation time can be reduced, and further, reading of the image on the sheet that is carried by the sheet container and formation of the image that is read by the image reader are possible.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sheet feeder comprising:

a sheet container for containing a plurality of sheets in a stacked manner;

an elevator for moving up/down the sheet container;

a sheet carrier for carrying an abutted sheet to a carrier path when the sheet container is moved up by the elevator;

a detector for detecting that the sheet container is located at a predetermined position; and a controller for remaining the sheet container at a position as it is without operating the elevator when the detector does not detect that the sheet container is located at the predetermined position upon powering on a power source.

2. The sheet feeder according to claim 1, wherein the predetermined position is the highest position of an elevation range of the sheet container, and the controller moves down the sheet container by means of the elevator when the detector detects that the sheet container is located at the highest position.

3. The sheet feeder according to claim 2, wherein the detector detects a position of the uppermost layer of the sheet that is contained in the sheet container, and in the case that the detector detects that the uppermost layer of the sheet is higher than a standard position when the sheet is contained in the sheet container, the controller moves down the sheet container by means of the elevator.

4. The sheet feeder according to claim 3, wherein the predetermined position also includes the lowest position of the elevation range of the sheet container, the sheet feeder further comprising:

a display for displaying a guidance for performing the carrier processing of the sheet to be carried in plural times in the case that the detector detects that the uppermost layer of the sheet is higher than the standard position and the sheet container is located at the lowest position when the sheet is contained in the sheet container.

5. An image reading apparatus comprising:

the sheet feeder according to claim 2; and an image reader for reading the image on the sheet carried by the sheet carrier.

6. An image forming apparatus comprising:

the sheet feeder according to claim 2;

an image reader for reading an image of a sheet carried by the sheet carrier; and an image forming unit for forming the image read by the image reader on paper.

7. The sheet feeder according to claim 1, wherein the predetermined position is the lowest position of an elevation range of the sheet container, and the controller moves up the sheet container by means of the elevator or remains the sheet container at the lowest position as it is without operating the elevator when the detector detects that the sheet container is located at the lowest position.

8. An image reading apparatus comprising:

the sheet feeder according to claim 7; and an image reader for reading the image on the sheet carried by the sheet carrier.

9. An image forming apparatus comprising:
the sheet feeder according to claim 7;
an image reader for reading an image of a sheet carried by the sheet carrier; and
an image forming unit for forming the image read by the image reader on paper.

10. The sheet feeder according to claim 1, further comprising:
an operation unit for giving an instruction to elevate the sheet container to the elevator, wherein
in the case that the detector does not detect that the sheet container is located at the predetermined position, the controller moves down the sheet container by means of the elevator when the operation of the operation unit is confirmed.

11. An image reading apparatus comprising:
the sheet feeder according to claim 10; and
an image reader for reading the image on the sheet carried by the sheet carrier.

12. An image forming apparatus comprising:
the sheet feeder according to claim 10;
an image reader for reading an image of a sheet carried by the sheet carrier; and
an image forming unit for forming the image read by the image reader on paper.

13. The sheet feeder according to claim 1, further comprising:
a sheet detector for detecting the sheet contained in the sheet container, wherein
in the case that the sheet detector detects that no sheet remains in the sheet container, the controller controls the elevator so that the sheet container is located at a predetermined position.

14. The sheet feeder according to claim 1, wherein
the powering on includes powering on again when the sheet feeder is returned from an energy saving mode.

15. An image reading apparatus comprising:
the sheet feeder according to claim 1; and
an image reader for reading the image on the sheet carried by the sheet carrier.

16. An image forming apparatus comprising:
the sheet feeder according to claim 1;
an image reader for reading an image of a sheet carried by the sheet carrier; and
an image forming unit for forming the image read by the image reader on paper.

17. A sheet feeder comprising:
a sheet container for containing a plurality of sheets in a stacked manner;
an elevator for moving up/down the sheet container;
a sheet carrier for carrying an abutted sheet to a carrier path when the sheet container is moved up by the elevator;
a detector for detecting that the sheet container is located at a predetermined position;
a storage unit for storing the operation state when a power source is turned off; and
a controller for controlling if a position of the sheet container is maintained or elevated with reference to the stored contents in the storage unit when the power source is turned on.

18. The sheet feeder according to claim 17, further comprising:
a sheet detector for detecting the sheet contained in the sheet container, wherein
in the case that the sheet detector detects that no sheet remains in the sheet container, the controller controls the elevator so that the sheet container is located at a predetermined position.

19. The sheet feeder according to claim 17, wherein
the powering on includes powering on again when the sheet feeder is returned from an energy saving mode.

20. An image reading apparatus comprising:
the sheet feeder according to claim 17; and
an image reader for reading the image on the sheet carried by the sheet carrier.

21. An image forming apparatus comprising:
the sheet feeder according to claim 17;
an image reader for reading an image of a sheet carried by the sheet carrier; and
an image forming unit for forming the image read by the image reader on paper.

* * * * *